US010798499B1

(12) United States Patent
El Guindi et al.

(10) Patent No.: US 10,798,499 B1
(45) Date of Patent: Oct. 6, 2020

(54) ACCELEROMETER-BASED SELECTION OF AN AUDIO SOURCE FOR A HEARING DEVICE

(71) Applicant: SONOVA AG, Staefa (CH)

(72) Inventors: Nadim El Guindi, Zürich (CH); Nina Stumpf, Maennedorf (CH); Ivo Spieler, Stäfa (CH); Ullrich Sigwanz, Hombrechtikon (CH)

(73) Assignee: Sonova AG, Staefa (CH)

( * ) Notice: Subject to any disclaimer, the term of this patent is extended or adjusted under 35 U.S.C. 154(b) by 32 days.

(21) Appl. No.: 16/370,536

(22) Filed: Mar. 29, 2019

(51) Int. Cl.
*H04R 25/00* (2006.01)

(52) U.S. Cl.
CPC ..... *H04R 25/558* (2013.01); *H04R 25/554* (2013.01); *H04R 25/604* (2013.01); *H04R 2225/55* (2013.01)

(58) Field of Classification Search
CPC combination set(s) only.
See application file for complete search history.

(56) References Cited

U.S. PATENT DOCUMENTS

| | | | |
|---|---|---|---|
| 20,100,054 | | 3/2010 | Goldin |
| 8,655,004 | B2 | 2/2014 | Prest et al. |
| 8,867,763 | B2 | 10/2014 | Bouse |
| 9,078,070 | B2 * | 7/2015 | Samuels ..... H04R 25/00 |
| 20,150,230 | | 8/2015 | Pedersen et al. |
| 9,769,577 | B2 * | 9/2017 | Shennib ..... H04R 25/554 |
| 2018/0035195 | A1 | 2/2018 | Bjelosevic et al. |

FOREIGN PATENT DOCUMENTS

| | | | |
|---|---|---|---|
| EP | 2363784 | A2 | 9/2011 |
| EP | 3021599 | A1 | 5/2016 |
| EP | 3264798 | A1 | 1/2018 |
| WO | 2014/108576 | A2 | 7/2014 |
| WO | 2016/174659 | A1 | 11/2016 |

* cited by examiner

*Primary Examiner* — Amir H Etesam
(74) *Attorney, Agent, or Firm* — ALG Intellectual Property, LLC

(57) ABSTRACT

An exemplary hearing device is configured to selectively connect to a remote audio source configured to provide remote audio content. The hearing device operates in a first audio rendering mode in which the processor provides the user with a first audio signal based on a first combination of at least one of the ambient audio content detected by a microphone and the remote audio content. The hearing device determines, while operating in the first audio rendering mode and based on the accelerometer data, a movement of the user. The hearing device determines, based on the movement of the user, whether to switch from operating in the first audio rendering mode to operating in a second audio rendering mode in which the processor provides the user with a second audio signal based on a second combination of at least one of the ambient audio content and the remote audio content.

20 Claims, 8 Drawing Sheets

ACCELEROMETER-BASED SELECTION OF AN AUDIO SOURCE FOR A HEARING DEVICE

BACKGROUND INFORMATION

A hearing device may be configured to selectively provide audio content from various sources to a user wearing the hearing device. For example, a hearing device may be configured to operate in a first audio rendering mode in which the hearing device renders or provides ambient audio content detected by a microphone to a user (e.g., by providing an amplified version of the ambient audio content to the user). The hearing device may alternatively operate in a second audio rendering mode in which the hearing device connects to a remote audio source (e.g., a phone, a remote microphone system, or other suitable device) and provides remote audio content output by the remote audio source to the user.

In some scenarios, it may be desirable for a hearing device to dynamically and intelligently switch between the first and second audio rendering modes described above. For example, while a user of a hearing device is listening to remote audio content (e.g., music) provided by a media player device to which the hearing device is connected, a person may approach the user and begin talking to the user. In this example, it may be desirable for the hearing device to dynamically and intelligently switch from operating in the second audio rendering mode to operating in the first audio rendering mode so that the user may hear the words spoken by the person. Heretofore, to do this, the user has had to manually provide input (e.g., by pressing a button on the hearing device or on the media player device) representative of a command for the hearing device to switch to the second audio rendering mode. Such manual interaction is cumbersome and time consuming, which may result in an embarrassing situation for the user and/or the user not hearing some of the words spoken by the person.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

Figure 1:
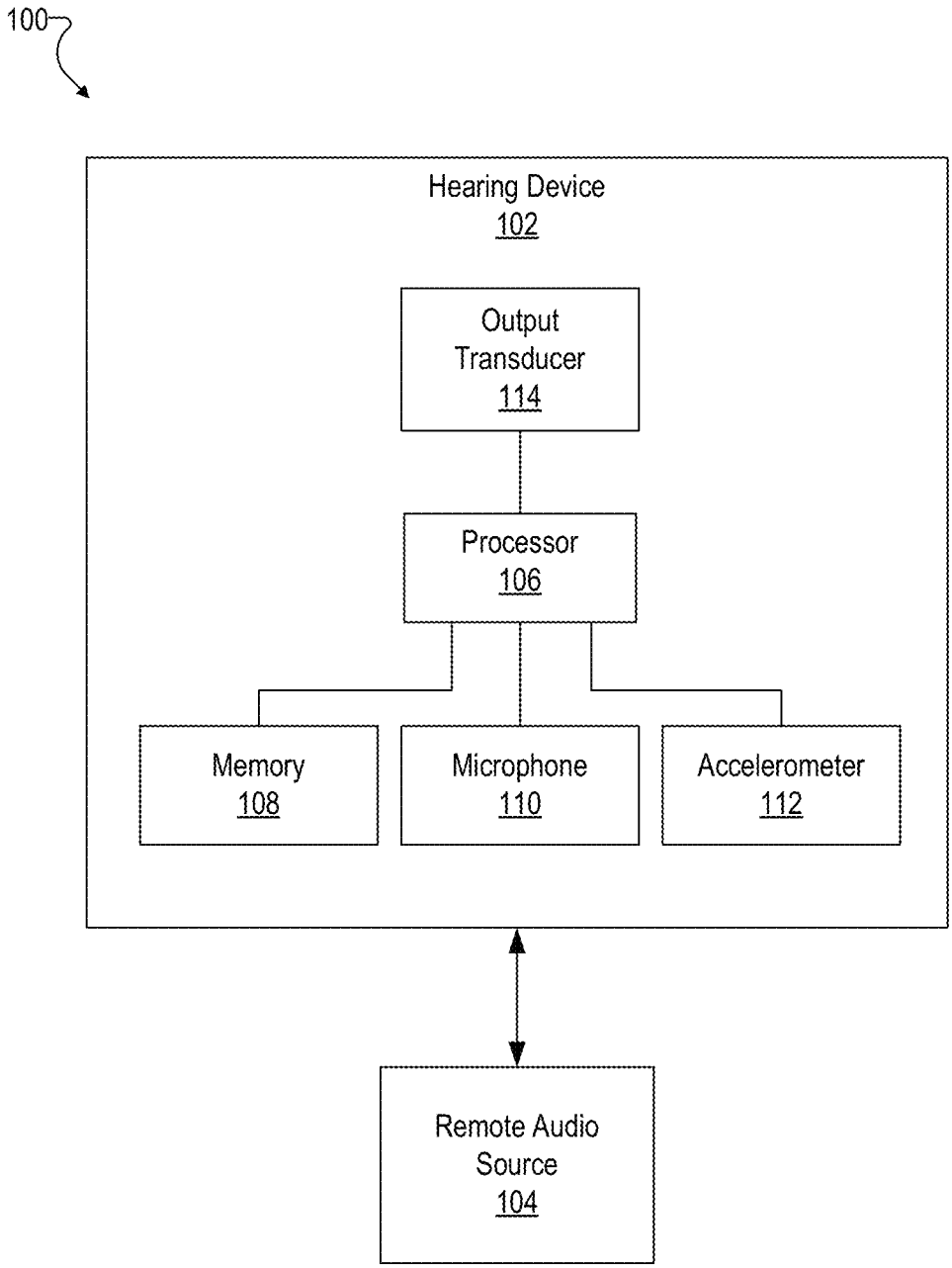
FIG. 1 shows an exemplary configuration in which a hearing device is configured to communicate with a remote audio source according to principles described herein.

Accelerometer-based selection of an audio source for a hearing device is described herein. For example, a hearing device configured to be worn by a user may include a microphone configured to detect ambient audio content, an accelerometer configured to output accelerometer data associated with the hearing device, and a processor communicatively coupled to the microphone and the accelerometer. The processor may be configured to selectively connect to a remote audio source configured to provide remote audio content, operate in a first audio rendering mode in which the processor provides the user with a first audio signal based on a first combination of at least one of the ambient audio content detected by the microphone and the remote audio content provided by the remote audio source, determine, while operating in the first audio rendering mode and based on the accelerometer data, a movement of the user, and determine, based on the movement of the user, whether to switch from operating in the first audio rendering mode to operating in a second audio rendering mode in which the processor provides the user with a second audio signal based on a second combination of at least one of the ambient audio content detected by the microphone and the remote audio content provided by the remote audio source.

For example, the first audio signal may be based more on the remote audio content than the ambient audio content (e.g., the first audio signal may be based solely on the remote audio content). Based on a movement of the user, the hearing device may determine that the user may want to hear more of the ambient audio content. For instance, the user may notice someone is speaking to him/her and may turn his/her head toward the speaker. Based on the accelerometer data output by the accelerometer, the hearing device may detect the head movement. If the hearing device also detects speech content in the ambient audio content detected by the microphone, the hearing device may automatically switch from the first audio rendering mode to the second audio rendering mode and thereby provide a second audio signal that is based more on the ambient audio content than the remote audio content. For example, the second audio signal may be based solely on the ambient audio content.

As another example, the first audio signal may be based more on the ambient audio content than the remote audio content. Based on a movement of the user, the hearing device may determine that the user may want to continue hearing more ambient audio content rather than switching to the second audio rendering mode that may provide more remote audio content. For instance, the hearing device may be configured to connect to the remote audio source based on a proximity to the remote audio source. However, if the user is walking repeatedly into and out of proximity to the remote audio source, the user may not be intending to repeatedly switch audio rendering modes to hear the remote audio source. Based on such movement of the user, the hearing device may determine to abstain switching audio rendering modes.

The systems, hearing devices, and methods described herein may advantageously provide many benefits to a user of a hearing device. For example, the systems, hearing devices, and methods described herein may allow a hearing device to switch or abstain from switching between providing audio from a remote source and from a microphone based on movement of the user that may indicate the user's listening intention. The hearing device may thus provide a seamless listening experience for the user. These and other benefits of the systems, hearing devices, and methods described will be made apparent herein.

FIG. 1 shows an exemplary configuration 100 in which a hearing device 102 is configured to selectively communicate with a remote audio source 104. Hearing device 102 may be implemented by any type of device configured to provide or enhance hearing to a user. For example, hearing device 102 may be implemented by a hearing aid configured to provide an audible signal (e.g., amplified audio content) to a user, a sound processor included in a cochlear implant system configured to apply electrical stimulation representative of audio content to a user, a sound processor included in a system configured to apply both acoustic and electrical stimulation to a user, or any other suitable hearing prosthesis. As shown, hearing device 102 includes a processor 106 communicatively coupled to a memory 108, a microphone 110, an accelerometer 112, and an output transducer 114. Hearing device 102 may include additional or alternative components as may serve a particular implementation.

Microphone 110 may be implemented by any suitable audio detection device and is configured to detect audio content ambient to a user of hearing device 102. The ambient audio content may include, for example, audio content (e.g., music, speech, noise, etc.) generated by one or more audio sources included in an environment of the user. Microphone 110 may be included in or communicatively coupled to hearing device 102 in any suitable manner.

Accelerometer 112 may be implemented by any suitable sensor configured to detect movement (e.g., acceleration) of hearing device 102, for instance an inertial sensor, such as a gyroscope. While hearing device 102 is being worn by a user, the detected movement of hearing device 102 is representative of movement by the user.

Output transducer 114 may be implemented by any suitable audio output device, for instance a loudspeaker of a hearing device or an output electrode of a cochlear implant system.

Memory 108 may be implemented by any suitable type of storage medium and may be configured to maintain (e.g., store) data generated, accessed, or otherwise used by processor 106. For example, memory 108 may maintain data representative of a plurality of audio rendering modes that specify how processor 106 processes (e.g., selects, combines, etc.) different types of audio content from different audio sources (e.g., ambient audio content detected by microphone 110 and remote audio content provided by remote audio source 104) to present the audio content to a user.

Processor 106 may be configured to perform various processing operations with respect to selecting audio sources to provide audio content to a user. For example, processor 106 may be configured to selectively receive ambient audio content detected by microphone 106, as well as remote audio content from remote audio source 104. Processor 106 may be configured to operate in various audio rendering modes that select and/or combine the ambient audio content and the remote audio content in various combinations to generate an audio signal to provide to the user, as described in more detail herein.

Processor 106 may be further configured to access accelerometer data generated by accelerometer 112. Processor 106 may use the accelerometer data to select an audio rendering mode in which to operate. For example, processor 106 may determine a movement of the user based on the accelerometer data. Processor 106 may determine whether the movement of the user indicates whether the user intends for the hearing device to continue operating in a first audio rendering mode or to switch to a second audio rendering mode. Example implementations and other operations that may be performed by processor 106 are described in more detail herein. In the description that follows, any references to operations performed by hearing device 102 may be understood to be performed by processor 106 of hearing device 102.

Remote audio source 104 may include any suitable device or system that provides audio content and is configured to communicate with hearing device 102. For example, remote audio source 104 may include a mobile device, a television, a computer, an internet server providing streaming music, an audio speaker, a remote microphone or any other such device that can provide an audio signal to hearing device 102. Remote audio content may include content received from remote audio source 104 at any time (e.g., streaming audio content and/or audio content downloaded to hearing device 102). Hearing device 102 may communicate with remote audio source 104 in any suitable manner, such as through a wireless interface (e.g., a Bluetooth interface) on each of hearing device 102 and remote audio source 104 and/or a wired interface. Hearing device 102 may be configured to selectively connect to remote audio source 104 and may also be configured to provide information (e.g., protocol information to connect to remote audio source 104, commands for controlling a providing of remote audio content such as playback, volume control, etc.) to remote audio source 104.

Figure 2:
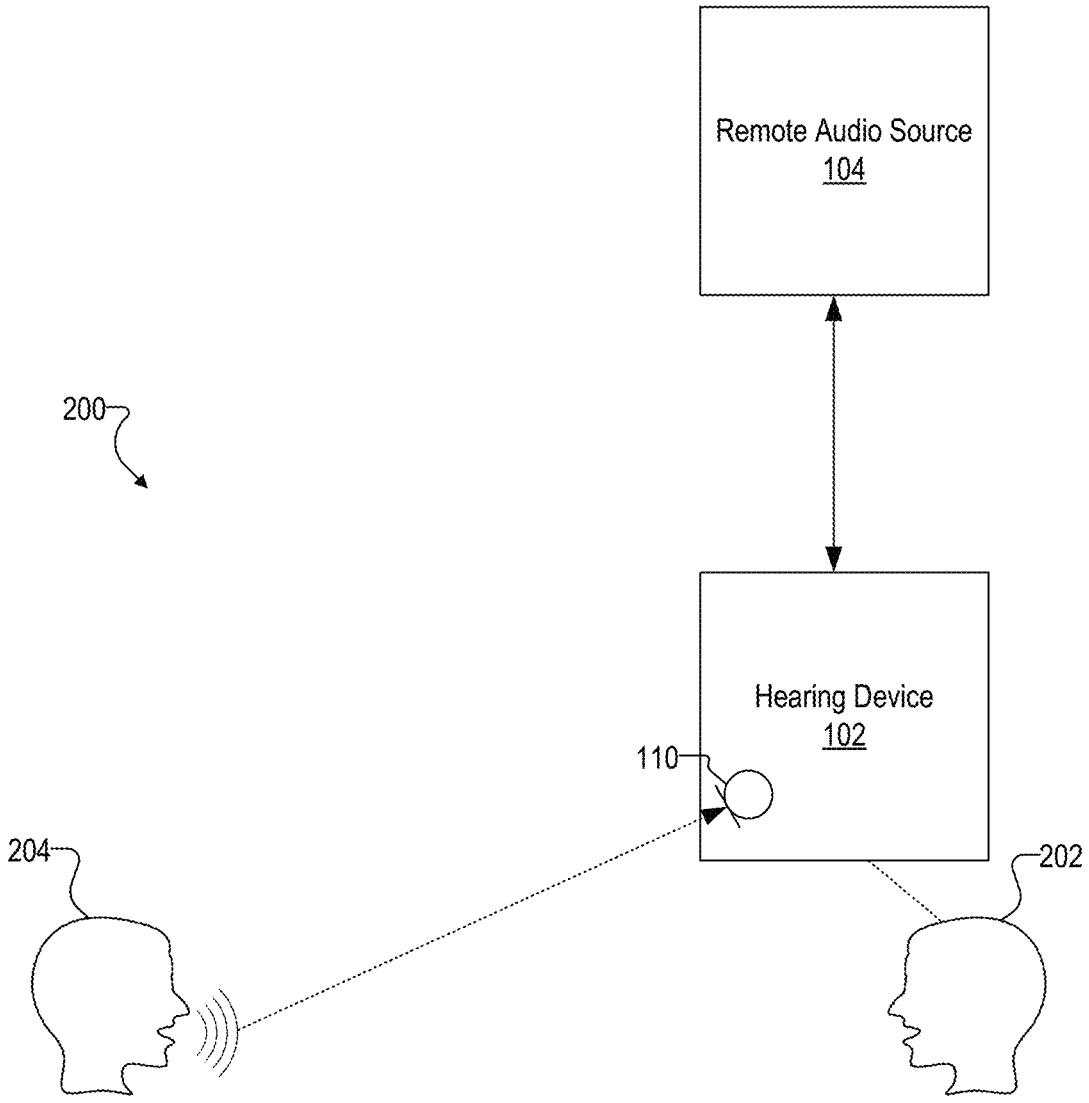
FIG. 2-3 illustrate exemplary configurations in which a hearing device is configured to select an audio source according to principles described herein.

FIG. 2 illustrates an exemplary configuration 200 in which hearing device 102 is configured to select an audio source based on accelerometer data. As shown, hearing device 102 is worn by a user 202 to enable or enhance hearing by user 202. Hearing device 102 is configured to connect to remote audio source 104, receive remote audio content from remote audio source 104, and provide the remote audio content to user 202. Hearing device 102 is also configured to provide ambient audio content detected by microphone 110 to user 202.

Hearing device 102 may operate in various audio rendering modes that provide user 202 with audio signals based on different combinations (e.g., weighted combinations) of the ambient audio content and the remote audio content based on movement of user 202. For example, hearing device 102 may be connected to remote audio source 104 and operating in a first audio rendering mode that provides a first audio signal. The first audio signal may be based more on the remote audio content than ambient audio content. Because the first audio signal is based less on the ambient audio content, user 202 may not easily hear the ambient audio content while hearing device 102 is operating in the first audio rendering mode (or not be able to hear the ambient audio at all if the first audio signal is based solely on the remote audio content). As such, user 202 may not easily or at all be able to hear speaker 204, though speaker 204 may be speaking to user 202. A conventional hearing device may be configured to receive a manual input from user 202 (and/or an input from remote audio source 104 resulting from a manual input by user 202 such as pausing or disconnecting remote audio source 104) to switch an audio rendering mode so that user 202 may be able to hear speech content provided by speaker 204. In contrast, hearing device 102 may dynamically and automatically determine whether to switch audio rendering modes based on accelerometer data, such as from accelerometer 112.

For example, hearing device 102 may detect (e.g., using microphone 110) that speaker 204 is speaking to user 202. User 202 may notice speaker 204, such as by seeing and recognizing speaker 204 and/or observing that speaker 204 is speaking to user 202. Additionally or alternatively, the first audio rendering mode may include some ambient audio content and user 202 may hear speaker 204 speaking to user 202. In response, user 202 may turn his/her head toward speaker 204 to focus his/her attention toward speaker 204 to listen to speaker 204 and/or verify that speaker 204 is speaking to user 202. Hearing device 102 may correlate the movement of user 202 (e.g., turning his/her head toward speaker 204) with a direction a source of the speech content (speaker 204) detected by microphone 110. If the direction of the source of the speech content correlates with the movement of user 202, hearing device 102 may determine that user 202 intends to switch audio rendering modes so that user 202 may hear the ambient audio source more than the remote audio source. Based on this determination, hearing device 102 may automatically (e.g., without user intervention and/or providing a request for confirmation) switch audio rendering modes. While configuration 200 shows speaker 204 providing speech content, accelerometer-based selection of the audio source may be implemented on any suitable specific content detected in the ambient audio content. For example, specific content may include speech content, moving noises, animal sounds, siren sounds, and any other such audio content distinguishable from a remainder of the ambient audio content. Example implementations for correlating the direction of the source of specific speech content with the movement of user 202 are described further herein.

Figure 3:
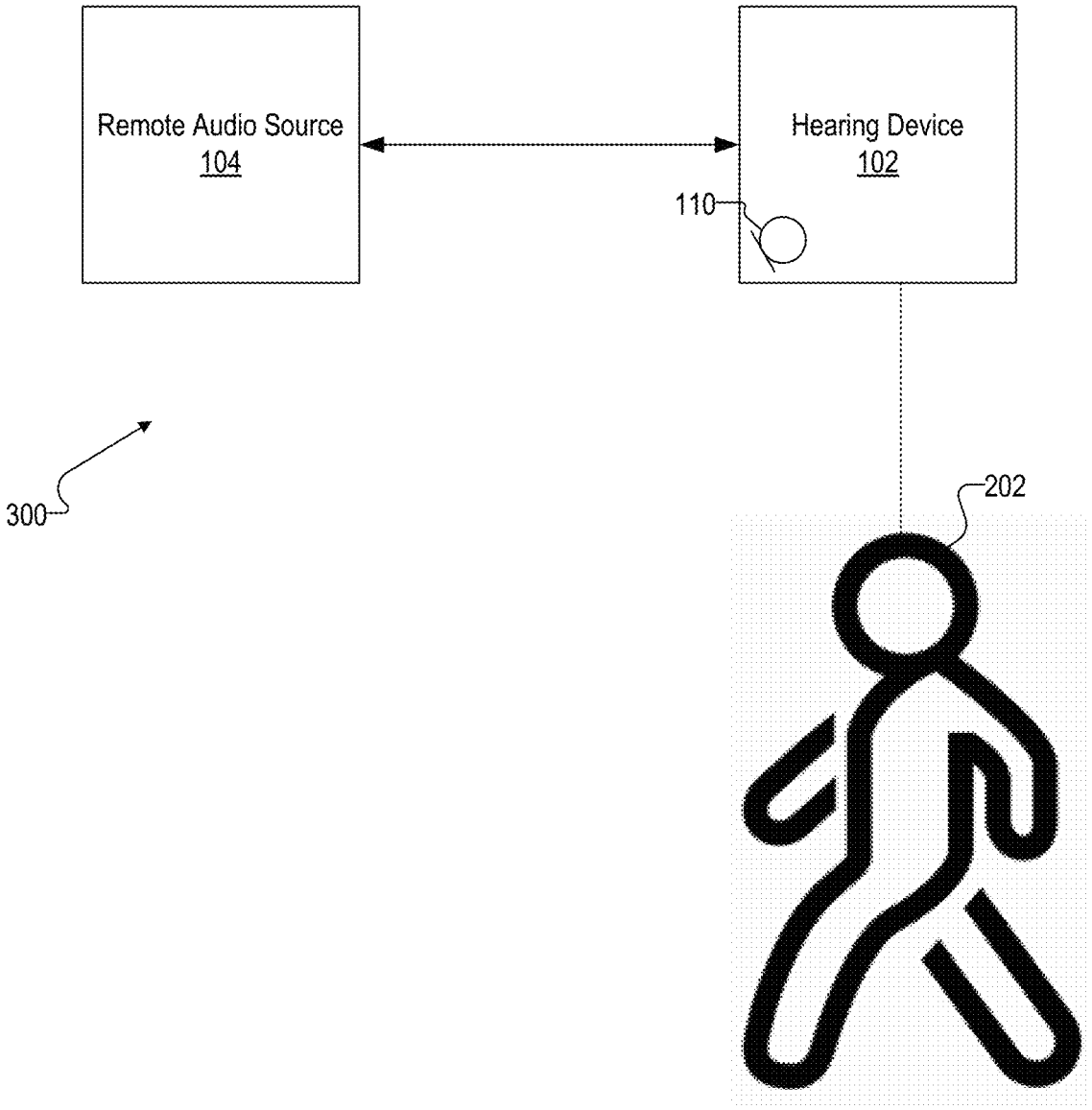

FIG. 3 illustrates another exemplary configuration 300 in which a hearing device is configured to select an audio source based on accelerometer data. Similar to FIG. 2, hearing device 102 is worn by user 202 and configured to connect to remote audio source 104. In this example configuration 300, hearing device 102 may determine whether to switch audio rendering modes based on a walking state of user 202. For example, if accelerometer data for user 202 indicates that user 202 is taking steps (e.g., walking, running, jogging, etc.), hearing device 102 may determine that user 202 intends to receive ambient audio content detected by microphone 110 rather that remote audio content provided by remote audio source 104.

For instance, remote audio source 104 may be a television or computer configured to provide audio content to hearing device 102 so that user 202 may hear audio content associated with video content provided by the television or computer. Hearing device 102 may be configured to automatically connect to remote audio source 104 based on a proximity to remote audio source 104. For example, if remote audio source 104 is a television that is on and user 202 is within a threshold distance away from the television, hearing device 102 may be configured to automatically connect to the television and provide an audio signal based on the remote audio content to user 202. However, in some instances, user 202 may be within the threshold distance but not intending to listen or watch the television. For example, someone else may be watching the television while user 202 cleans a floor near the television or mows a lawn right outside but within the threshold distance of the television. In such a case, user 202 may not want hearing device 102 to repeatedly connect and disconnect to remote audio source 104 (which would happen if user 202 keeps going in and outside of the threshold distance while cleaning the floor and/or mowing the lawn). As hearing device 102 may determine that the movement of user 202 to be in a walking state based on accelerometer data, hearing device 102 may abstain from switching audio rendering modes, even though other criteria to provide remote audio content may be met.

As another example, remote audio source 104 may be a remote microphone system, such as if user 202 is a student in a classroom setting. In such a setting, a teacher may speak into a remote microphone that may connect to hearing device 102 and provide remote audio content. However, if the student is outside the classroom but the teacher leaves the remote microphone on, hearing device 102 may continue to provide remote audio content to user 202. In such a case, if hearing device 102 determines that user 202 is taking steps, hearing device 102 may determine that user 202 intends to receive ambient audio content rather that the remote audio content. Hearing device 102 may then remain in (e.g., abstain from switching from) an audio rendering mode that is based more on the ambient audio content than the remote audio content if hearing device 102 is already in that audio rendering mode. Otherwise, if the hearing device 102 is operating in an audio rendering mode that is based more on the remote audio content, hearing device 102 may switch to a different audio rendering mode that is based more on the ambient audio content based on determining that user 202 is taking steps.

Figure 4:
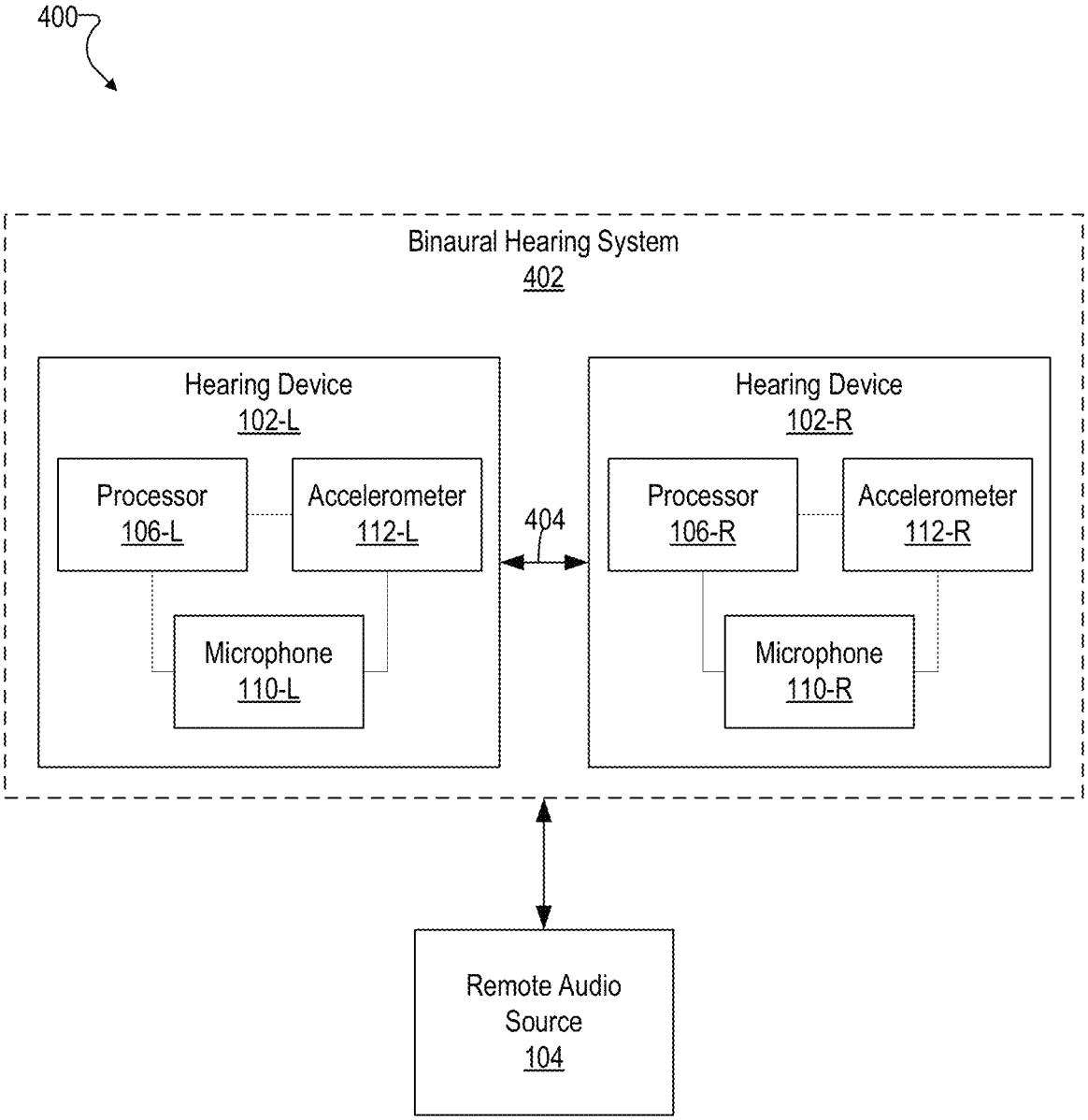
FIG. 4 illustrates an exemplary configuration in which binaural hearing system is configured to communicate with a remote audio source according to principles described herein.

FIG. 4 illustrates an exemplary configuration 400 in which a binaural hearing system 402 is configured to select audio sources base on accelerometer data. As shown, binaural hearing system 402 includes a left hearing device 102-L and a right hearing device 102-R (collectively "hearing devices 102"). Each of hearing devices 102 may be implemented as described above in FIGS. 1-3. Alternatively, binaural hearing system 402 may include asymmetric left and right hearing devices. For example, one or more of the components such as the accelerometer, microphone, etc. may each be included in only one or the other of hearing devices 102. The hearing device with the component may communicate with the other hearing device (as indicated by arrow 404) to provide audio content, information specifying audio render modes, etc.

Binaural hearing system 402 is configured to selectively connect to remote audio source 104. Either or both of hearing devices 102 may connect to remote audio source 104 to receive remote audio content. Hearing devices 102 may include wired and/or wireless interfaces to connect and communicate with remote audio source 104 and with each other.

As shown, hearing devices 102 each include a microphone 110 (e.g., microphone 110-L or microphone 110-R), which may enable binaural hearing system 402 to accurately determine a direction of a source of speech or other ambient audio content. For example, by analyzing various features and differences in the features in the audio signal received by each hearing device 102, binaural hearing system 402 may determine the direction of the source of the speech content. Example features may include a signal-to-noise ratio (SNR), levels (e.g., volumes), onset, time differences in receiving the audio signal, etc. Example analyses may include estimating the binaural SNR differences, estimating a modulation depth or dynamics, percentile analysis, comparing speech modulations with cardioid patterns (e.g., for determining front or back directions), etc. Binaural hearing system 402 may also use such techniques as well as other speech recognition algorithms to determine that the ambient audio content includes speech content. Additionally or alternatively, each hearing device 102 may include additional microphones which may also provide more information for determining direction of audio sources. For example, a plurality of microphones in hearing device 102 may allow hearing device 102 to use beam forming, as well as providing additional data points for analysis using the example techniques described.

As shown, hearing devices 102 also each include an accelerometer 112 (e.g., accelerometer 112-L or accelerometer 112-R), which may enable binaural hearing system 402 to accurately determine a movement of a user. For example, by analyzing a slope, value, sign, etc. of accelerometer data received from both accelerometer 112-L and 112-R, binaural hearing system 402 may determine which direction a user turns his/her head. Binaural hearing system 402 may then compare and correlate the direction of the user's head movement with the direction of the source of the ambient audio content to determine whether or which audio rendering mode to operate in.

Figure 5:
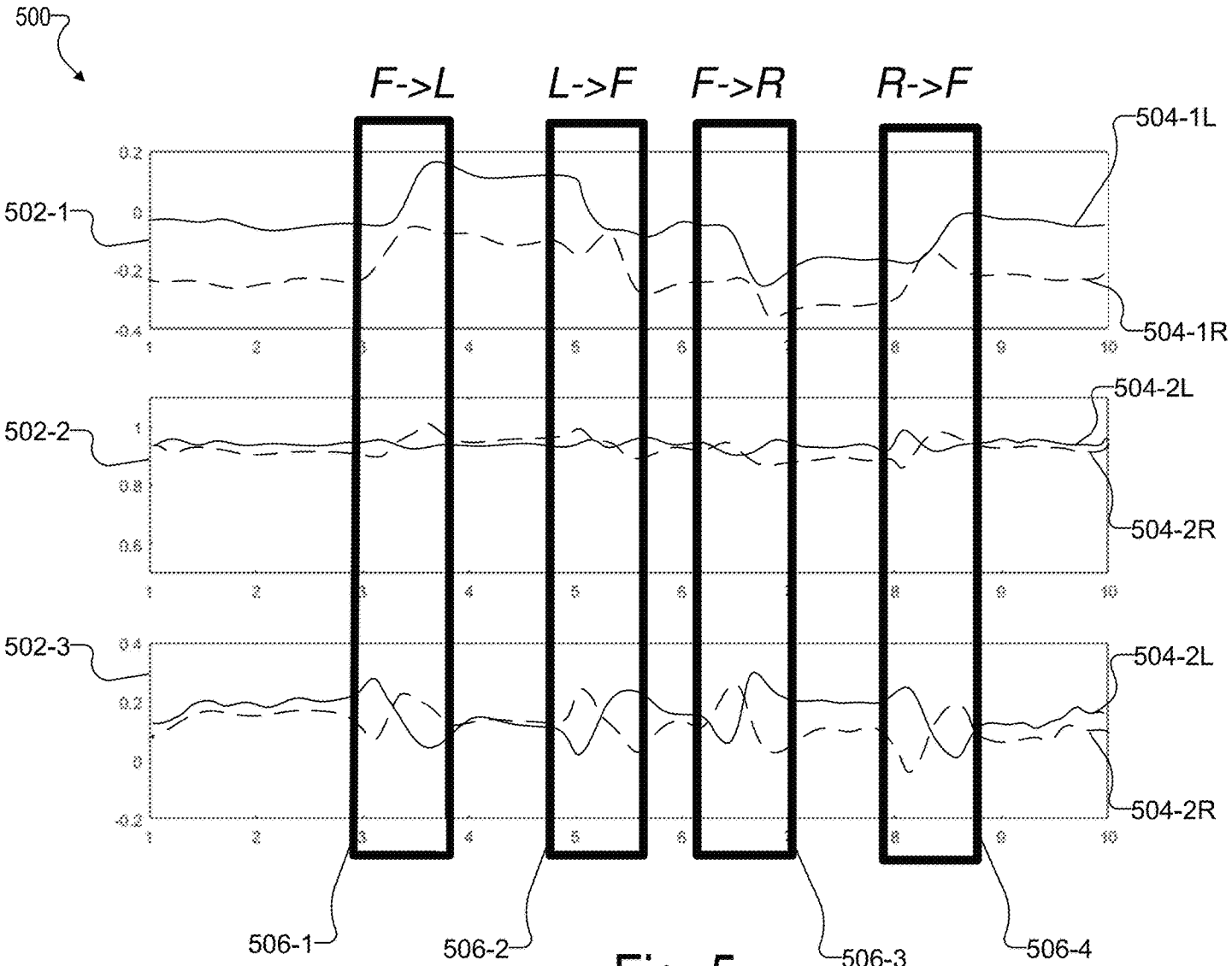
FIG. 5 illustrates exemplary signals received from accelerometers of a binaural hearing system according to principles described herein.

For example, FIG. 5 shows exemplary accelerometer data 500 received from accelerometers 112 of binaural hearing system 402.

Accelerometer data 500 shows three graphs 502-1, 502-2, 502-3 showing accelerometer signals for each of x-, y-, and z-coordinate axes, respectively. Each of graphs 502 show two signals, 504-L and 504-R corresponding to data from accelerometer 112-L and 112-R. For example, graph 502-1 shows x-axis accelerometer signal 504-1L output by accelerometer 112-L and x-axis accelerometer signal 504-1R output by accelerometer 112-R, graph 502-2 shows y-axis accelerometer signal 504-2L output by accelerometer 112-L and y-axis accelerometer signal 504-2R output by accelerometer 112-R, and graph 502-3 shows z-axis accelerometer signal 504-3L output by accelerometer 112-L and z-axis accelerometer signal 504-3R output by accelerometer 112-R.

Vertically boxed portions 506 of graphs 502 correspond to different types of head movements. Vertically boxed portion 506-1 shows example signals 504 corresponding to a head turn from a front-facing direction to a left-facing direction. Vertically boxed portion 506-2 shows example signals 504 corresponding to a head turn from a left-facing direction to a front-facing direction. Vertically boxed portion 506-3 shows example signals 504 corresponding to a head turn from a front-facing direction to a right-facing direction. Vertically boxed portion 506-4 shows example signals 504 corresponding to a head turn from a right-facing direction to a front-facing direction. Similar analyses may be used to determine varying degrees of head turns, including a back-facing direction, as well as a downward-facing direction to a front-facing direction (e.g., if a user is looking down at a phone and raises his/her head to look at someone speaking to him/her).

Figure 6:
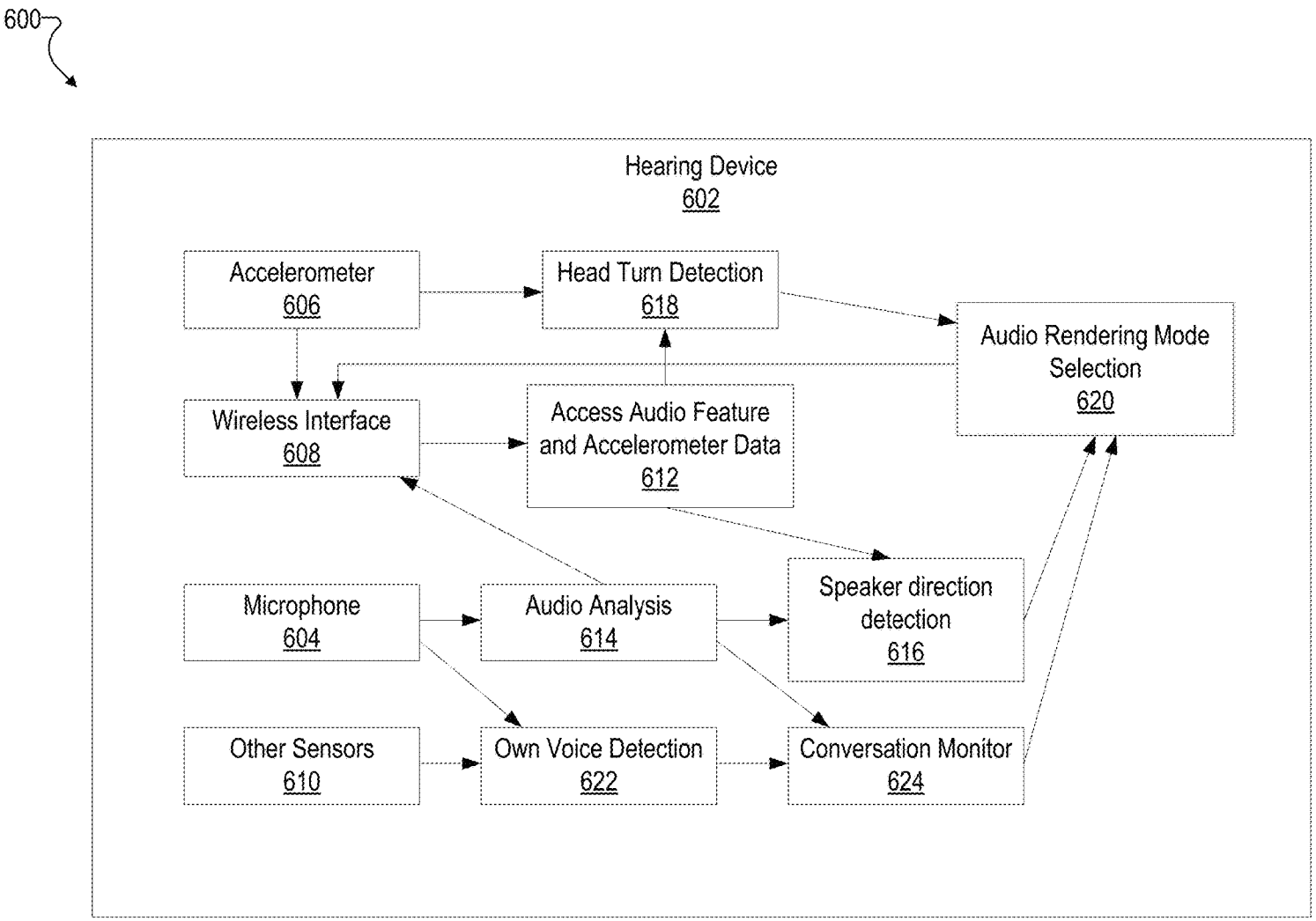
FIGS. 6-7 illustrate various signal processing operations that may be performed by a hearing device according to principles described herein.

FIG. 6 illustrates exemplary signal processing operations 600 that may be performed by a hearing device 602 to select audio sources using accelerometer data. Hearing device 602 is similar to the other hearing devices described herein. As shown, hearing device 602 includes a microphone 604, an accelerometer 606, as well as a wireless interface 608 and other sensors 610. Other sensors 610 may include sensors such as canal microphones, bone conduction sensors, etc. Other sensors 610 may provide a variety of types of information to hearing device 602, details of which will be further described below. As also shown, hearing device 602 is configured to implement an access module 612, an audio analysis module 614, a speaker direction detection module 616, a head turn detection module 618, an audio rendering mode selection module 620 ("selection module 620"), an own voice detection module 622, and a conversation monitor module 624, each of which may be implemented by processor-readable instructions configured to be executed by a processor of hearing device 602.

Wireless interface 608 may provide for communication with another hearing device, such as in a binaural hearing system, as well as with a remote audio source. Access module 612 accesses SNR data (and/or other such feature data) of audio content detected by the other hearing device via wireless interface 608. Access module 612 also accesses accelerometer data and/or features of accelerometer data from the other hearing device via wireless interface 608.

Audio analysis module 614 is configured to analyze audio content detected by hearing device 602. For example, audio analysis module 614 may determine the SNR of the audio content, as described herein. Hearing device 602 provides data from such analyses to the other hearing device via wireless interface 608.

Based on the analysis of the audio signal detected by hearing device 602 and the analysis of the audio signal detected by the other hearing device (e.g., as accessed by access module 612), speaker direction detection module 616 may detect a direction of a speaker. Any suitable algorithms and analyses may be used to detect the direction of the speaker, as described herein.

Head turn detection module 618 is configured to determine a movement of the user, such as a turning of a head of the user and/or a walking state of the user. To this end, head turn detection module 618 receives accelerometer data of hearing device 602 from accelerometer 606 as well as accelerometer data of the other hearing device (e.g., as accessed by access module 612). Based on the analysis of the accelerometer data of hearing device 602 and the accelerometer data of the other hearing device, head turn detection module 618 may determine a direction of a user's head turn.

Selection module 620 is configured to select an audio rendering mode for hearing device 602. For example, selection module 620 receives information from modules 616 and 618 to compare and/or correlate a direction of a speaker and a direction of a user's head turn. If the correlation is positive (e.g., within a predetermined range), selection module 620 may instruct hearing device 602 to operate in an audio rendering mode that is based more on ambient audio content than remote audio content. If the correlation is negative or neutral (e.g., outside the predetermined range), selection module 620 may instruct hearing device 602 to operate in an audio rendering mode that is based more on the remote audio content than the ambient audio content.

Selection module 620 may also allow for a period of time in which to correlate the user's movement and the direction of the speaker. For example, the user may notice the speaker before the speaker starts speaking, and move his/her head in the speaker's direction before hearing device 602 receives any ambient audio content from the speaker's direction. Conversely, user may not notice the speaker until after the speaker starts speaking, in which case the movement of the speaker that correlates with the direction of the speaker may be detected after the detection of the direction of the speaker. But in both instances, the correlation may be considered positive. As another example of a movement of a user, the user may turn his/her head toward the speaker initially, and then turn back (e.g., toward a mobile device or an initial direction the user was facing) upon realizing the speaker was not speaking to the user or the user has no intention of listening. In such a case, the period of time used in correlating the user's movement may allow for ultimately determining that the user's movement does not correlate with the direction of the speaker and thus hearing device 602 should not switch audio rendering modes.

In some examples, selection module 620 may determine that the user's movement correlates with the speaker's direction and instruct hearing device 602 to operate in an audio rendering mode that is based entirely on ambient audio content. Additionally, selection module 620 may provide a command to the remote audio source via wireless interface 604 to pause the providing of the remote audio content. Selection module 620 may also determine that the user intends to switch back to listening to the remote audio content and provide a command to the remote audio source to resume the providing of the remote audio content. Selection module 620 may detect such an intention in various ways. For example, selection module 620 may detect a movement of the user away from the direction of the speaker or back to an initial direction the user was facing, or toward a direction of the remote audio source. Additionally or alternatively, other sensors 610 of hearing device 602 may provide information to determine that the user is also speaking and thus having a conversation with the speaker.

Own voice detection module 622 is configured to detect whether the user of hearing device 602 is speaking. In some examples, own voice detection module 622 may use information from microphone 604 and/or other sensors 610. For example, a bone conduction sensor may detect vibrations in the user's head caused when the user speaks. Microphone 604 may also provide an indication that the user's own voice is being detected, based on direction, levels, SNR estimation, voice recognition techniques, etc. Based on a determination from own voice detection module 622, conversation monitor module 624 may monitor the conversation between the user and the speaker. While the conversation is taking place, conversation monitor module 624 may provide to selection module 620 an indication that the user remains intending to listen to ambient audio content and selection module 620 may instruct hearing device 602 to remain in a corresponding audio rendering mode. Once conversation monitor module 624 detects no conversation for a certain amount of time, conversation monitor module 624 may indicate as such to selection module 620, which may instruct hearing device 602 to switch back to an audio rendering mode that is based more on the remote audio content. As mentioned, such an instruction may be accompanied by a command to the remote audio source to resume the providing of the remote audio content.

In some examples, hearing device 602 may disconnect from the remote audio source upon determining that hearing device 602 will operate in an audio rendering mode that is based entirely on ambient audio content. In such examples, hearing device 602 may automatically reconnect to the remote audio source based on determining a user's intention to resume listening to remote audio content.

In some instances, a binaural hearing system (e.g., which may include two of hearing device 602), may switch audio rendering modes asymmetrically between the two hearing devices. For example, if the binaural hearing system determines that a direction of a speaker is on the right side, the binaural hearing system may switch the audio rendering mode of the right hearing device while keeping the audio rendering mode of the left hearing device the same. Alternatively, the binaural hearing system may switch the audio rendering modes of the right and left hearing devices to different audio rendering modes. For instance, if the binaural hearing system determines that the direction of the speaker is on the right side, the binaural hearing system may switch the audio rendering mode of the right hearing device to one based entirely on ambient audio content, while switching the audio rendering mode of the left hearing device to one based more on ambient audio content than remote audio content, but still based in part on remote audio content.

Figure 7:
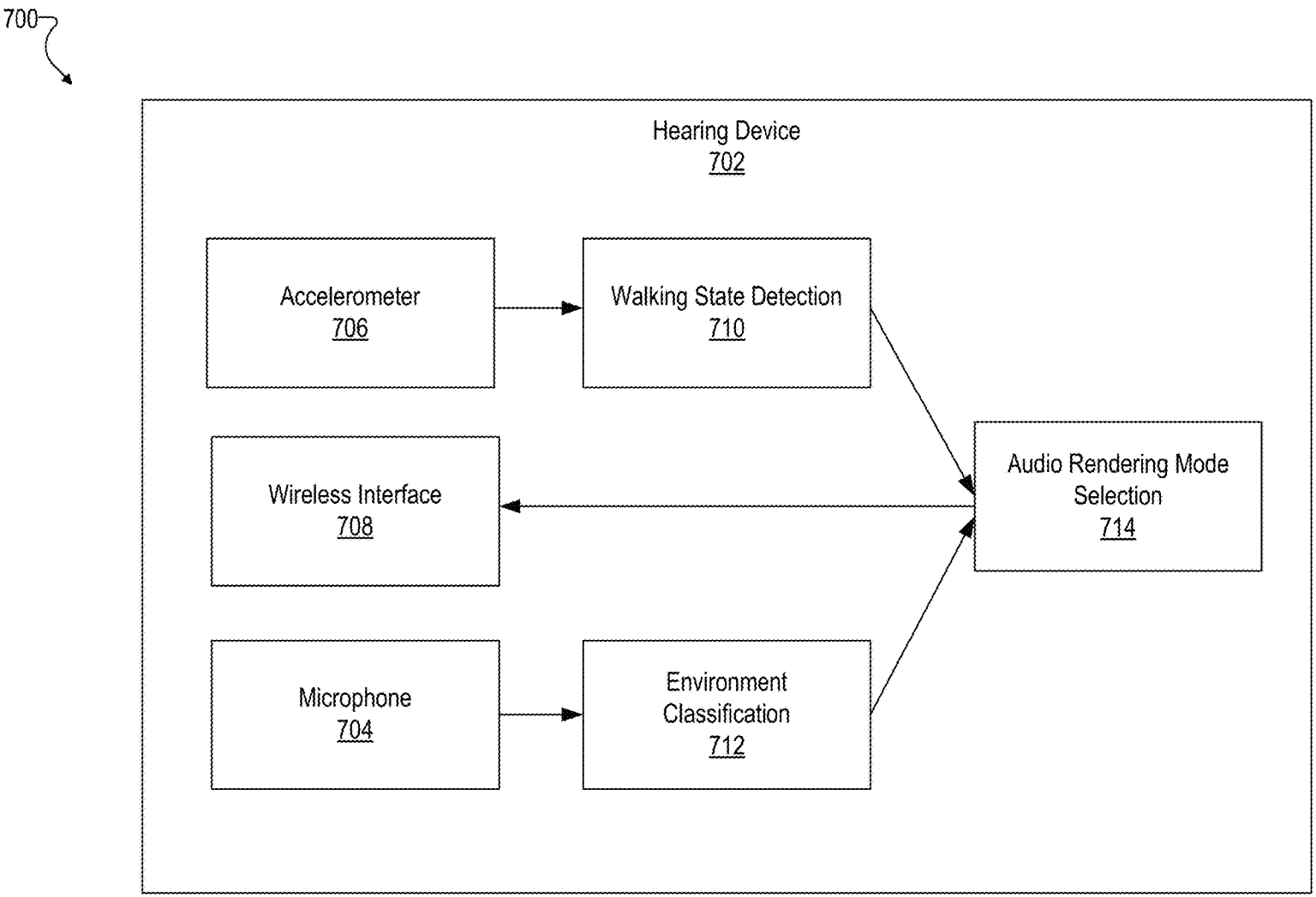

FIG. 7 illustrates exemplary signal processing operations 700 that may be performed by a hearing device 702 to select audio sources using accelerometer data. Hearing device 702 is similar to any of the hearing devices described herein. As shown, hearing device 702 includes a microphone 704, an accelerometer 706, and a wireless interface 708. Hearing device 702 also includes a walking state detection module 710 configured to determine a walking state of the user. Walking state detection module 710 may receive accelerometer data (e.g., from accelerometer 706) to determine whether the user's walking state is one of taking steps (e.g., walking, running, jogging, etc.) or whether the walking state is one of not taking steps (e.g., standing, sitting, lying down, driving, etc.). Walking state detection module 710 may detect that the user is taking steps using any suitable algorithm. For example, walking state detection module 710 may use step modulation frequency detection using y-mean crossings. As another example, walking state detection module 710 may also use machine learning algorithms for activity primitive recognition.

Hearing device 702 also includes a classification module 712 that receives information from microphone 704 to classify an environment of the user. For example, classification module 712 may determine whether the user is situated indoors or outdoors. Classification module 712 may use any suitable algorithms to classify the user's environment. For example, classification module 712 may detect audio cues, such as wind or a lack of reverberation in the audio signal to determine that the user is outdoors.

Hearing device 702 includes a selection module 714 that uses the walking state of the user as well as the environment classification to select an audio rendering mode. For example, hearing device 702 may be configured to provide audio from a remote audio source. However, based on the walking state of the user being one of taking steps combined with the environment of the user being outside, in some instances, selection module 714 may determine that the user intends to remain listening to ambient audio content and direct hearing device 702 not to switch from such an audio rendering mode. Selection module 714 may also take into account various factors, such as duration of the walking state, regularity of steps taken, distance of walking or running to make the selection. For example, in some cases, the user may be jogging outside and may intend to listen to music provided by a mobile device while jogging. In such cases, the regularity and distance of the steps taken by the user may indicate that the user intends to listen to more of the remote audio source than the ambient audio source.

Hearing device 702 may provide prompts to the user to confirm selections of audio rendering modes. For example, hearing device 702 may determine that the user intends to remain in an audio rendering mode that is based entirely on ambient audio content. However, along with such a determination, hearing device 702 may still prompt the user (e.g., via the remote audio source) whether the user wishes to switch audio rendering modes to receive remote audio content. In this way, if hearing device 702 has correctly determined that the user wishes to remain listening to the ambient audio content, the user may not even notice the prompt, and hearing device 702 will continue to seamlessly provide the audio content the user intends to listen to. Additionally or alternatively, hearing device 702 may prompt the user for confirmation on a determination of an intention to switch audio rendering modes. Hearing device 702 may also be configured to learn from inputs received by these prompts to better learn the intentions of the user and the accelerometer and environmental data that corresponds to the intentions.

Figure 8:
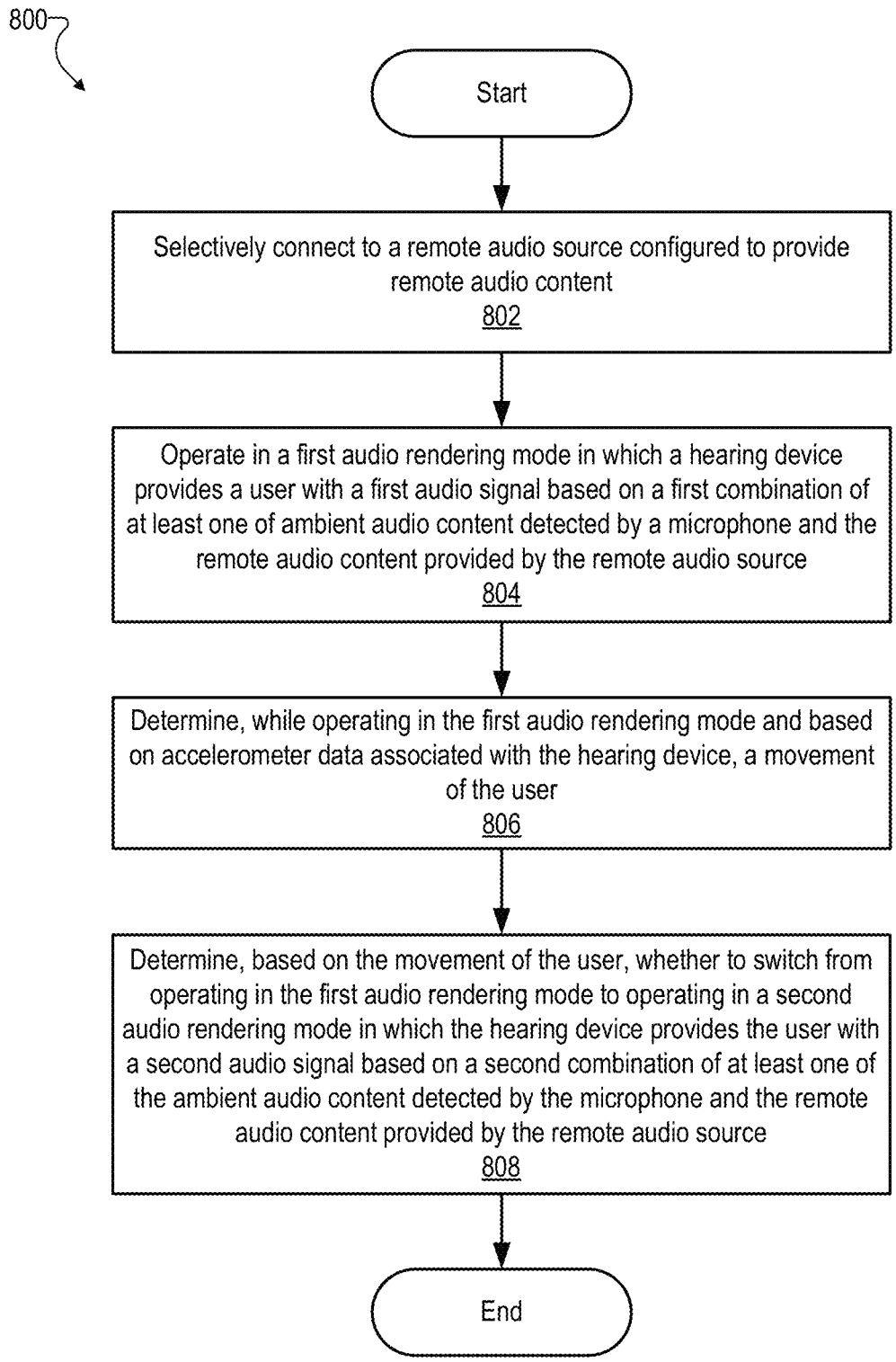
FIG. 8 illustrates an exemplary method according to principles described herein.

FIG. 8 illustrates an exemplary method 800. One or more of the operations shown in FIG. 8 may be performed by any of the hearing devices described herein. While FIG. 8 illustrates exemplary operations according to one embodiment, other embodiments may omit, add to, reorder, and/or modify any of the operations shown in FIG. 8.

In step 802, a hearing device selectively connects to a remote audio source configured to provide remote audio content. Step 802 may be performed in any of the ways described herein.

In step 804, the hearing device operates in a first audio rendering mode in which the hearing device provides a user with a first audio signal based on a first combination of at least one of ambient audio content detected by a microphone and the remote audio content provided by the remote audio source. Step 804 may be performed in any of the ways described herein.

In step 806, the hearing device determines, while operating in the first audio rendering mode and based on accelerometer data associated with the hearing device, a movement of the user. Step 806 may be performed in any of the ways described herein.

In step 808, the hearing device determines, based on the movement of the user, whether to switch from operating in the first audio rendering mode to operating in a second audio rendering mode in which the hearing device provides the user with a second audio signal based on a second combination of at least one of the ambient audio content detected by the microphone and the remote audio content provided by the remote audio source. Step 808 may be performed in any of the ways described herein.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A hearing device configured to be worn by a user, the hearing device comprising:

a microphone configured to detect ambient audio content;

an accelerometer configured to output accelerometer data associated with the hearing device; and a processor communicatively coupled to the microphone and the accelerometer, the processor configured to:

selectively connect to a remote audio source configured to provide remote audio content;

operate in a first audio rendering mode in which the processor provides the user with a first audio signal based on a first combination of at least one of the ambient audio content detected by the microphone and the remote audio content provided by the remote audio source;

determine, while operating in the first audio rendering mode and based on the accelerometer data, a movement of the user; and determine, based on the movement of the user, whether to switch from operating in the first audio rendering mode to operating in a second audio rendering mode in which the processor provides the user with a second audio signal based on a second combination of at least one of the ambient audio content detected by the microphone and the remote audio content provided by the remote audio source.

2. The hearing device of claim 1, wherein the first audio signal is based more on the remote audio content than on the ambient audio content, wherein the processor is further configured to:

detect, in the ambient audio content, specific content; and determine a direction of a source of the specific content, and wherein the determining whether to switch from operating in the first audio rendering mode to operating in the second audio rendering mode is based on whether the movement of the user correlates with the direction of the source of the specific content.

3. The hearing device of claim 2, wherein the processor is further configured to:

determine that the movement of the user correlates with the direction of the source of the specific content; and switch, based on the determination that the movement of the user correlates with the direction of the source of the specific content, from operating in the first audio rendering mode to operating in the second audio rendering mode in which the processor provides the user with the second audio signal;

wherein the second audio signal is based more on the ambient audio content than on the remote audio content.

4. The hearing device of claim 3, wherein the processor is further configured to:

detect, while in the second audio rendering mode and using at least one of the microphone and another sensor of the hearing device, whether the user is speaking; and determine, based on the detecting of whether the user is speaking, whether to switch back from operating in the second audio rendering mode to operating in the first audio rendering mode.

5. The hearing device of claim 3, wherein:

the first audio signal is based entirely on the remote audio content, and the second audio signal is based entirely on the ambient audio content.

6. The hearing device of claim 5, wherein the processor is further configured to disconnect, based on the switching from operating in the first audio rendering mode to operating in the second audio rendering mode, from the remote audio source.

7. The hearing device of claim 5, wherein the processor is further configured to direct, based on the switching from operating in the first audio rendering mode to operating in the second audio rendering mode, the remote audio source to pause the providing of the remote audio content.

8. The hearing device of claim 7, wherein the processor is further configured to:

detect, while in the second audio rendering mode and using at least one of the microphone and another sensor of the hearing device, that the user is not speaking for a threshold length of time;

switch, based on the detecting that the user is not speaking for the threshold length of time, back from operating in the second audio rendering mode to operating in the first audio rendering mode; and direct, based on the switching from operating in the second audio rendering mode to operating in the first audio rendering mode, the remote audio source to resume the providing of the remote audio content.

9. The hearing device of claim 1, wherein:

the processor is further configured to determine, based on the movement of the user, a walking state of the user; and the determining whether to switch from operating in the first audio rendering mode to operating in the second audio rendering mode is based on the walking state of the user.

10. The hearing device of claim 9, wherein:

the first audio signal is based more on the ambient audio content than on the remote audio content;

the second audio signal is based more of the remote audio content than on the ambient audio content; and the processor is configured to abstain from switching from operating in the first audio rendering mode to operating in the second audio rendering mode if the walking state indicates that the user is taking steps.

11. The hearing device of claim 1, wherein:

the determining whether to switch from operating in the first audio rendering mode to operating in the second audio rendering mode comprises determining that the processor is to switch from operating in the first audio rendering mode to operating in the second audio rendering mode; and the processor is further configured to provide, based on the determining that the processor is to switch from operating in the first audio rendering mode to operating in the second audio rendering mode, the user with a prompt to confirm the determination to switch from operating in the first audio rendering mode to operating in the second audio rendering mode.

12. The hearing device of claim 1, wherein the processor is further configured to:

determine one or more acoustic environment classifications of the user while operating in the first audio rendering mode, and wherein the determining whether to switch from operating in the first audio rendering mode to operating in the second audio rendering mode is additionally based on the one or more acoustic environment classifications.

13. A hearing system comprising:

a first hearing device configured for a first ear of a user, the first hearing device comprising a first microphone configured to detect ambient audio content;

a second hearing device configured for a second ear of the user, the second hearing device comprising a second microphone configured to detect the ambient audio content;

an accelerometer configured to output accelerometer data associated with at least one of the first hearing device and the second hearing device; and a processor communicatively coupled to the first hearing device, the second hearing device, and the accelerometer, the processor configured to:

selectively connect to a remote audio source configured to provide remote audio content;

operate in a first audio rendering mode in which the processor provides the user with a first audio signal based on a first combination of at least one of the ambient audio content and the remote audio content provided by the remote audio source;

detect, in the ambient audio content, specific content;

determine a direction of a source of the specific content;

determine, while operating in the first audio rendering mode and based on the accelerometer data, a movement of the user; and determine, based on a correlation between the movement of the user and the direction of the source of the specific content, whether to switch from operating in the first audio rendering mode to operating in a second audio rendering mode in which the processor provides the user with a second audio signal based on a second combination of at least one of the ambient audio content and the remote audio content provided by the remote audio source.

14. The hearing system of claim 13, wherein the determining of the direction of the source of the specific content comprises:

determining a first signal-to-noise ratio of the specific content detected by the first microphone;

determining a second signal-to-noise ratio of the specific content detected by the second microphone; and comparing the first signal-to-noise ratio and the second signal-to-noise ratio.

15. The hearing system of claim 13, wherein the processor is further configured to:

operate, based on the determination of whether to switch from operating in the first audio rendering mode to operating in a second audio rendering mode, the first hearing device in the first audio rendering mode and the second hearing device in the second audio rendering mode.

16. A method comprising:

selectively connecting, by a hearing device, to a remote audio source configured to provide remote audio content;

operating, by the hearing device, in a first audio rendering mode in which the hearing device provides a user of the hearing device with a first audio signal based on a first combination of at least one of ambient audio content detected by a microphone of the hearing device and the remote audio content provided by the remote audio source;

determining, by the hearing device, while operating in the first audio rendering mode and based on accelerometer data from an accelerometer, a movement of the user; and determining, by the hearing device and based on the movement of the user, whether to switch from operating in the first audio rendering mode to operating in a second audio rendering mode in which the hearing device provides the user with a second audio signal based on a second combination of at least one of the ambient audio content detected by the microphone and the remote audio content provided by the remote audio source.

17. The method of claim 16, wherein the first audio signal is based more on the remote audio content than on the ambient audio content, the method further comprising:

detecting, by the hearing device, in the ambient audio content, specific content; and determining, by the hearing device, a direction of a source of the specific content, and wherein the determining whether to switch from operating in the first audio rendering mode to operating in the second audio rendering mode is based on whether the movement of the user correlates with the direction of the source of the specific content.

18. The method of claim 17, further comprising:

determining, by the hearing device, that the movement of the user correlates with the direction of the source of the specific content;

switching, by the hearing device and based on the determining that the movement of the user correlates with the direction of the source of the specific content, from operating in the first audio rendering mode to operating in the second audio rendering mode in which the hearing device provides the user with the second audio signal;

wherein the second audio signal is based more on the ambient audio content than on the remote audio content.

19. The method of claim 16, further comprising determining, by the hearing device and based on the movement of the user, a walking state of the user;

wherein the determining whether to switch from operating in the first audio rendering mode to operating in the second audio rendering mode is based on the walking state of the user.

20. The method of claim 19, wherein:

the first audio signal is based more on the ambient audio content than on the remote audio content;

the second audio signal is based more of the remote audio content than on the ambient audio content; and the method further comprising abstaining, by the hearing device, from switching from operating in the first audio rendering mode to operating in the second audio rendering mode if the walking state indicates that the user is taking steps.

* * * * *